US011459676B2

(12) United States Patent
Archontopoulos et al.

(10) Patent No.: US 11,459,676 B2
(45) Date of Patent: Oct. 4, 2022

(54) AUTOMATIC RING SPINNING SYSTEM AND METHOD FOR AUTOMATICALLY OPERATING SAME

(71) Applicant: Uster Technologies AG, Uster (CH)

(72) Inventors: Vasileios Archontopoulos, Uster (CH); Sivakumar Narayanan, Uster (CH); Peter Schmid, Zurich (CH); Kurt Eggimann, Saland (CH); Paul Geiter, Pfaffikon (CH)

(73) Assignee: Uster Technologies AG, Uster (CH)

( * ) Notice: Subject to any disclaimer, the term of this patent is extended or adjusted under 35 U.S.C. 154(b) by 0 days.

(21) Appl. No.: 15/733,761

(22) PCT Filed: May 27, 2019

(86) PCT No.: PCT/CH2019/000017
§ 371 (c)(1),
(2) Date: Oct. 19, 2020

(87) PCT Pub. No.: WO2019/227242
PCT Pub. Date: Dec. 5, 2019

(65) Prior Publication Data

US 2021/0164132 A1 Jun. 3, 2021

(30) Foreign Application Priority Data

May 28, 2018 (CH) ..... 00675/18
Aug. 7, 2018 (CH) ..... 00964/18

(51) Int. Cl.
*D01H 13/32* (2006.01)
*B65H 63/00* (2006.01)
(Continued)

(52) U.S. Cl.
CPC ..... *D01H 13/32* (2013.01); *B65H 63/006* (2013.01); *B65H 67/063* (2013.01); *D01H 1/02* (2013.01); *D01H 9/18* (2013.01); *B65H 2701/31* (2013.01)

(58) Field of Classification Search
CPC . D01H 13/32; D01H 1/02; D01H 9/18; B65H 63/006; B65H 67/063
See application file for complete search history.

(56) References Cited

U.S. PATENT DOCUMENTS 4,222,657 A 9/1980 Leuchter
4,660,370 A 4/1987 Matsui et al.
(Continued)

FOREIGN PATENT DOCUMENTS

DE 4306095 A1 10/1993
DE 19918780 A1 5/2000
(Continued)

OTHER PUBLICATIONS

English translation of WO 9215737, to Lucca, Sep. 1992, accessed via espacenet.com (last visited Oct. 5, 2021) (Year: 2021).*
Uster Sentinel brochure, Uster Technologies, 2016.

*Primary Examiner* — Shaun R Hurley
*Assistant Examiner* — Patrick J. Lynch
(74) *Attorney, Agent, or Firm* — TechnicalAttorney Rick Barnes

(57) ABSTRACT

Automatic operation of a ring spinning system containing a ring spinning machine having spinning positions and a winding machine having winding positions. Yarn is spun at one of the spinning positions and wound up to a cop. Values of a parameter characteristic for the operation of the spinning position are determined during the winding of the cop and stored as spinning data that is assigned to the cop. The spinning data assigned to the cop is taken into account when deciding whether to feed the cop after it has been set down
(Continued)

to one of the winding positions. The assignment is based on an identification of a point in time of winding of the cop and an identification of the spinning position at which the cop was wound.

16 Claims, 5 Drawing Sheets

(51) Int. Cl.

| | |
|---|---|
| ***B65H 67/06*** | (2006.01) |
| ***D01H 1/02*** | (2006.01) |
| ***D01H 9/18*** | (2006.01) |

(56) References Cited

U.S. PATENT DOCUMENTS

| | | | | | |
|---|---|---|---|---|---|
| 4,843,808 | A * | 7/1989 | Ruge | B65H 63/006 57/264 |
| 5,381,340 | A * | 1/1995 | Ueda | B65H 67/06 57/264 |
| 2009/0223199 | A1* | 9/2009 | Wassenhoven | D01H 13/32 57/362 |
| 2013/0346007 | A1* | 12/2013 | Schmid | G01N 33/365 702/84 |

FOREIGN PATENT DOCUMENTS

| | | | | |
|---|---|---|---|---|
| DE | 4209203 | | 11/2005 | |
| DE | 102015004305 | A1 | 10/2016 | |
| EP | 0392278 | A1 | 10/1990 | |
| EP | 3305953 | A1 | 4/2018 | |
| WO | WO-9215737 | A1 * | 9/1992 | D01H 13/145 |
| WO | WO-2007056883 | A2 * | 5/2007 | G01N 33/365 |
| WO | WO-2010009565 | A1 * | 1/2010 | D01H 13/22 |
| WO | 2014022189 | A1 | 2/2014 | |
| WO | 2014051730 | A1 | 4/2014 | |
| WO | WO-2018212293 | A1 * | 11/2018 | B65H 63/00 |

* cited by examiner

700

| 701 | 702 | 703 | 704 |
|---|---|---|---|
| 0001 | 001L | 14377 | 0.67 |
| 0001 | 002L | 02111 | 1.33 |
| 0001 | 003L | 11382 | 8.00 |
| 0001 | 004L | 12204 | 1.33 |
| | | | |
| 0002 | 001L | 06255 | 2.00 |
| 0002 | 002L | 03418 | 2.00 |
| 0002 | 003L | 12770 | 0.00 |
| 0002 | 004L | 00939 | 0.67 |
| | | | |
| 1200 | 540R | 07426 | 2.67 |

705

Fig. 7

AUTOMATIC RING SPINNING SYSTEM AND METHOD FOR AUTOMATICALLY OPERATING SAME

FIELD OF THE INVENTION

The present invention lies in the field of ring spinning. It relates to an automatic ring spinning machine and a method for its automatic operation, according to the independent patent claims.

DESCRIPTION OF THE PRIOR ART

A ring spinning system usually includes a ring spinning machine and a winding machine.

The ring spinning machine has a plurality of spinning positions. At each spinning position, roving is unwound from a roving bobbin, stretched, twisted (spun) and wound as yarn onto a cop (yarn bobbin). Systems for monitoring the operation of the spinning positions, e.g. for detecting yarn breaks or "slip spindles" (i.e. spindles that operate at a speed below the set machine speed), are known. Such spinning monitoring systems typically measure the rotational speed of the respective ring traveler (e.g. U.S. Pat. No. 4,222,657 A) or the yarn (e.g. WO—2014/022189 A1). The former category includes the ring spinning optimization system USTER® SENTINEL, which is described in the brochure "USTER® SENTINEL—The ring spinning optimization system", Uster Technologies AG, 2016. The ring spinning optimization system USTER® SENTINEL generates a cop build-up report, which graphically displays, among other things, the average number of yarn breaks and the average speed of rotation as a function of the position along a longitudinal axis of a cop. The cop build-up report is displayed on a screen to an operator.

After their production, the cops are transported from the ring spinning machine to a winding machine. Cop tracking systems are known which make it possible to assign a cop in the winding machine to the spinning position on which it was produced. The assignment can be made, for example, by means of an identification carrier on the cop ring tube (e.g. U.S. Pat. No. 4,660,370 A) or on a bobbin plate (caddy) which transports the cop (e.g. DE-42'09'203 A1).

The winding machine has a large number of winding positions. At each winding position several cops are rewound one after the other onto a cross-wound bobbin. The purpose of rewinding is to produce large yarn bobbins that can be transported and used efficiently. During the rewinding process, the properties of the yarn are monitored and compared with predefined quality criteria. If the quality criteria are not met, the defective part can be removed from the yarn. So-called yarn clearing systems are known for this purpose, e.g. from WO—2012/051730 A1.

DE—43'06'095 A1 discloses a method and a device for controlling a networked spinning installation. The spinning installation comprises a ring spinning machine, a service robot assigned to the ring spinning machine and a winding machine with a yarn clearer linked to the ring spinning machine. It is equipped with a cop tracking system. Information is exchanged to optimize the spinning installation. The service robot not only carries out service operations, but also collects information on the status of the spinning positions and yarn breaks in the individual cops. The winding machine or its yarn clearers can use the cop tracking system to determine that a particular spindle of the ring spinning machine is consistently producing bad yarn.

EP—3'305'953 A1 discloses a yarn winding system with a spinning machine and an automatic winding machine. The spinning machine is equipped with a monitoring device to generate spinning information and a transmission unit to send the spinning information to the winding machine. The winding machine is provided with a receiving unit for receiving the spinning information and a control unit for controlling the operation of the winding machine based on the spinning information received by the receiving unit.

DE—10'2015'004'305 A1 relates to a method for operating a composite system consisting of at least one ring spinning machine and at least one winding machine. The total thread length wound on the bobbins is determined in each case, and the supply of the cops to the winding positions is carried out as a function of the determined total thread length. When distributing the cops to the winding positions, thread breaks on the cops can be taken into account in order to distribute splices evenly on the cross-wound bobbins.

DE—199'18'780 A1 proposes to connect the ring spinning machine to a test station. In this station the yarns are automatically checked for hairiness and the cops are automatically sorted depending on the test result. Thus, for one and the same end product only cops with yarns without differences in hairiness are used.

According to EP—0'392'278 A1, the cops on bobbin supports pass through a converter which connects at least one ring spinning machine and at least one winding machine. In the area of the converter, data relating to different yarn qualities are assigned to the bobbin supports equipped with cops. Mixed bobbins with different qualities are coded and transferred to the corresponding areas of the winding machine behind the converter.

SUMMARY OF THE INVENTION

It is an object of the present invention to increase the productivity and/or profitability of an automatic ring spinning system. It is a further object to increase the quality of the yarn bobbins produced by a ring spinning system. It is also an object to reduce quality costs in the textile manufacturing process downstream of the ring spinning system.

These and other objects are solved by the method and automatic ring spinning system as defined in the independent claims. Advantageous embodiments are specified in the dependent claims.

The invention is based on the idea of determining values of a parameter characteristic for the operation of the spinning position during spinning, in particular during the winding of the cop, automatically assigning them to the cop and taking them into account in an automatic decision on feeding the cop to one of the winding positions. The automatic assignment is based on an identification of a point in time when the cop is wound up and an identification of the spinning position where the cop was wound up. Cops during whose production or winding problems occurred can thus be sorted out before rewinding. They can be disposed of as scrap or rewound to yarn spools of inferior quality.

The method according to the invention serves for the automatic operation of a ring spinning system which comprises a ring spinning machine having a plurality of spinning positions for spinning yarn and a winding machine having a plurality of winding positions for rewinding the yarn. Yarn is spun at one of the spinning positions and wound into a cop. For the spinning position, values of a parameter characteristic for the operation of the spinning position are determined during the winding of the cop and stored as spinning data. The spinning data are assigned to the cop. The cops are taken off the spinning position. The spinning data assigned to the cop is taken into account for an automatic decision on feeding the cop after it has been set down to one of the winding positions. An identification of a point in time of winding of the cop and an identification of the spinning position are automatically assigned to the cop. The spinning data are automatically assigned to the cop based on the identification of the point in time of cop winding and the identification of the spinning position.

In one embodiment, the spinning data, the identification of the point in time of winding of the cop and the identification of the spinning position are stored in a relational database. The identification of the point in time of winding of the cop and the identification of the spinning position are used in the relational database as a key for the identification of the spinning data to be assigned to the cop. An identification carrier can be assigned to the cop, identification data of the identification carrier can be stored in the relational database, and the identification of the point in time of winding of the cop and the identification of the spinning position in the relational database can be used as a key to identify both the spinning data to be assigned to the cop and the identification data of the identification carrier. Preferably, the decision to feed a first cop for several subsequent cops, which were wound at the same spinning position as the first cop after the first cop, is taken for the subsequent cops without considering their spinning data.

In one embodiment, the decision is made on at least one of the following questions:

Is the cop fed to one of the winding positions?

The cop is fed to which of the winding positions?

When is the cop fed to one of the winding positions?

In one embodiment, the cops are sorted out after being set down and are not fed to any of the winding positions at least during a waiting period.

In one embodiment, at least two classes of similar spinning data are formed. For each of the at least two classes the decision is made and a result of the decision is assigned to the respective class. The cop is classified into one of the at least two classes according to the stored spinning data. After the cop has been set down, it is processed according to the result assigned to the respective class. Preferably, the yarn is rewound from the cop onto a bobbin at each of the winding positions, and cops classified in the same class are fed one after the other in time to one of the winding positions in such a way that the yarn wound on these cops is rewound onto a single bobbin. The cops classified in the same class can be temporarily stored after being set down before they are fed to the winding position.

In one embodiment, the parameter characteristic for the operation of the spinning station comprised by the spinning data is selected from the following set: number of yarn breaks per time unit, ring traveler speed, air temperature, air humidity.

The automatic ring spinning system according to the invention comprises a ring spinning machine having a large number of spinning positions for spinning yarn and winding the yarn onto one cop each. It further comprises a spinning monitoring system for monitoring the operation of the spinning positions, with a spinning sensor at each of the spinning positions for measuring a spinning measured quantity and a spinning monitoring control unit connected to the spinning sensor, which is adapted to receive values of the spinning measured quantity from the spinning sensor of a spinning position during the winding of a cop, to determine therefrom values of a parameter characteristic for the operation of the spinning position and to store them as spinning data. The ring spinning system comprises a set-down device for setting down the cops from the spinning positions. It also comprises a winding machine having a large number of winding positions for rewinding the yarn from a respective cop to a yarn bobbin. The ring spinning system also comprises a feed system controlled by a feed control unit for feeding the cops set down from the set-down device to the winding positions, and an assignment system for assigning the spinning data to the respective cop. The feed control unit is connected to the spinning monitoring control unit and is adapted to make a decision on feeding a respective cop to one of the winding positions taking into account the spinning data assigned to the cop by the assignment system. The assignment system is adapted to assign an identification of a point in time of winding of the cop and an identification of the spinning position on which the cop was wound to the cop and to assign the spinning data to the cop on the basis of the identification of the point in time of winding of the cop and the identification of the spinning position.

In one embodiment, the assignment system comprises a relational database. The relational database is adapted to store the spinning data, the identification of the point in time of the winding of the cop and the identification of the spinning position, as well as to use the identification of the point in time of the winding of the cop and the identification of the spinning position as a key to identify the spinning data to be assigned to the cop. The assignment system can be adapted to assign an identification carrier to the cop, to store identification data of the identification carrier in the relational database and to use the identification of the point in time of the winding of the cop and the identification of the spinning position in the relational database as a key for the identification of both the spinning data to be assigned to the cop and the identification data of the identification carrier. The assignment system is preferably adapted to take the decision to feed a first cop for several subsequent cops, which were wound after the first cop at the same spinning position as the first cop, for the subsequent cops without taking their spinning data into account.

In one embodiment, the ring spinning system additionally comprises a separating station for receiving such cops which are separated by the feed control unit and are not fed to any of the winding positions at least during a waiting period.

In one embodiment, the spinning monitoring control unit is adapted to determine values of the parameter characteristic for the operation of the spinning position from the following set and to store them as spinning data: number of yarn breaks per time unit, ring traveler speed, air temperature, air humidity.

Thanks to the invention, cops that have experienced problems during their production or winding can be sorted out. This eliminates cuts caused by yarn clearers at the winding machine, thus increasing the efficiency of the winding machine and ultimately the overall productivity of the automatic ring spinning system. The invention also reduces the risk of yarn defects reaching the yarn bobbin. It therefore increases the quality of the yarn bobbins produced by the automatic ring spinning system. The invention also offers the possibility of selectively producing yarn bobbins of several different quality classes, wherein the yarn bobbins within a quality class have a homogeneous quality level. Depending on the quality class, the yarn bobbins can be sold at different prices for different further uses, thus increasing the profitability of the ring spinning system. In the textile manufacturing process downstream of the ring spinning system, the use of yarn bobbins of homogeneous quality reduces the quality costs because fewer problems occur during the further processing of the yarn bobbins (e.g. in the weaving or knitting mill) and the textile end product has fewer defects and irregularities.

BRIEF DESCRIPTION OF THE DRAWINGS

In the following, the invention is explained in detail on the basis of the drawings.

FIG. 7 schematically depicts a relational database for use in the method according to the invention as a table.

IMPLEMENTATION OF THE INVENTION

Figure 1:
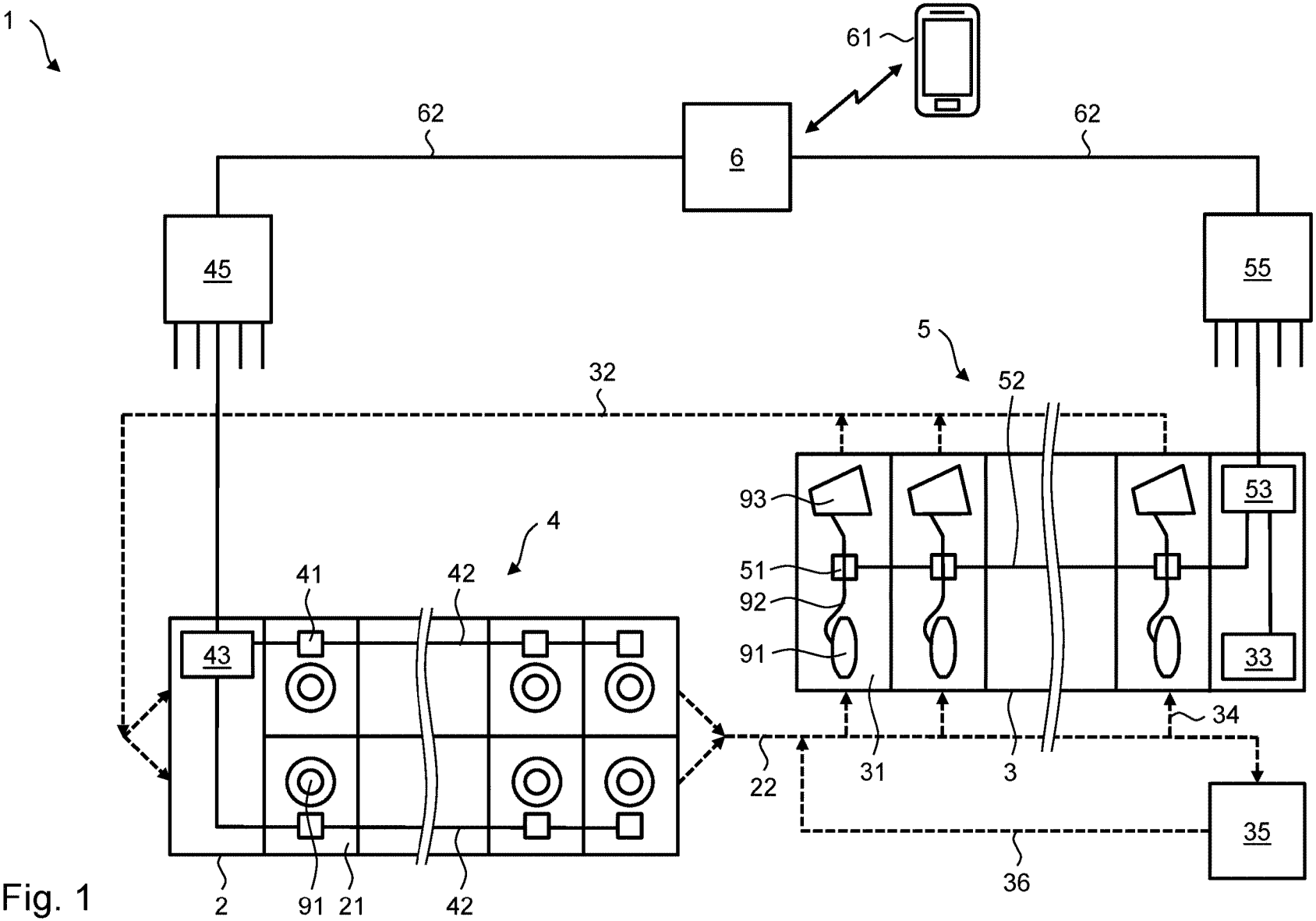
FIG. 1 shows schematically a ring spinning system according to the invention.

FIG. 1 shows a schematic diagram of an automatic ring spinning system 1. The ring spinning system comprises a ring spinning machine 2 and a winding machine 3.

Ring spinning machine 2 comprises a plurality of spinning positions 21. At each spinning position 21, yarn is spun from roving by means of the well-known ring spinning process and wound into a so-called cop 91. The ring spinning machine 2 is equipped with a spinning monitoring system 4 for monitoring the operation of spinning positions 21, e.g. for detecting yarn breaks or "slip spindles". The spinning monitoring system 4 contains a spinning sensor 41 at each of the spinning positions 21. The spinning sensor 41 measures a spinning measured quantity. Each spinning sensor 41 is connected to a spinning monitoring control unit 43 via a wired or wireless first data line 42. The spinning sensor 41 sends values of the spinning measured quantity to the spinning monitoring control unit 43 via the first data line 42. The spinning monitoring control unit 43 receives the values. It determines values of a parameter characteristic for the operation of spinning position 21 from these values for at least two different times during the winding of the cop 91 and stores the determined values as spinning data. Examples of the parameter characteristic for the operation of spinning position 21 are a number of yarn breaks per unit of time, a ring traveler speed, an air temperature and an air humidity.

The full, simultaneously produced cops 91 are set down ("doffed") simultaneously by the ring spinning machine 2; for this purpose, ring spinning machine 1 is equipped with a set-down device, which, however, is not shown in the drawings for the sake of simplicity. After doffing, the bobbins 91 are transported to winding machine 3, which is indicated in FIG. 1 by dashed arrows 22.

The winding machine 3 comprises a plurality of winding positions 31. At each winding position 31, yarn 92 is rewound from several cops 91 one after the other onto a yarn bobbin 93, e.g. a cross-wound bobbin. The winding machine 3 can be equipped with a yarn monitoring system 5 for monitoring the properties of yarn 92. The yarn monitoring system 5 contains a yarn sensor 51 at each of the winding positions, which is connected to a yarn monitoring control unit 53 via a wired or wireless second data line 52. The yarn monitoring system 5 can, for example, be designed as a yarn clearing system, wherein each yarn sensor 51 can be assigned a yarn cutting unit that removes impermissible yarn defects from yarn 92.

Normally, a cop 91 is automatically fed to one of the winding positions 31 after it has been set down by ring spinning machine 2, as indicated by the dashed arrows 34 in FIG. 1. The cops 91 are fed to the winding positions 31 by an automatic feeding system controlled by a feed control unit 33. The feed control unit 33 can be a stand-alone unit or it can coincide with a control unit of winding machine 3.

The feed control unit 33 is connected to the spinning monitoring control unit 43. The connection can be made via a wired or wireless third data line 62. In the exemplary embodiment in FIG. 1, three additional devices 45, 6, 55 are located along the third data line 62. These devices receive data transmitted via the third data line 62, process it if necessary, and transmit it further. These are not necessary for the present invention and are only briefly described below.

In one embodiment, the ring spinning system 1 comprises a central control and evaluation unit 6, which is connected via the third data line 62 to the spinning monitoring control unit 43 and to the yarn monitoring control unit 53. The central control and evaluation unit 6 receives data from the spinning monitoring control unit 43 and/or from the yarn monitoring control unit 53, processes them, controls the ring spinning system 1 or parts thereof and/or outputs information to an operator. For this purpose, it is preferably connected to an input unit and/or an output unit via which the operator can make inputs or receive outputs. In the exemplary embodiment of FIG. 1, a mobile device 61, e.g. a cell phone, which communicates wirelessly with the central control and evaluation unit 6, is shown as input and output unit. Alternatively or additionally, other input units known per se, e.g. a computer keyboard and output units such as a computer screen, can be used.

In one embodiment, the ring spinning system 1 comprises several spinning monitoring systems 4 on one or more ring spinning machines 2, whose spinning monitoring control units 43 are connected to a spinning expert system 45. The spinning expert system 45 is adapted to receive, process and output data from the spinning monitoring control unit 43 in a suitable form and to control the spinning monitoring control unit 43. It is in turn connected to the central control and evaluation unit 6.

In one embodiment, the ring spinning system 1 comprises several yarn monitoring systems 5 on one or more winding machines 3, whose yarn monitoring control units 53 are connected to a yarn expert system 55. The yarn expert system 55 is adapted to receive, process and output data from the yarn monitoring control units 53 in a suitable form and to control the yarn monitoring control units 53. It is in turn connected to the central control and evaluation unit 6.

The ring spinning system 1 in accordance with the invention comprises an assignment system (not drawn as an independent unit) for assigning the spinning data to the corresponding cop 91. A possibility of assignment is now described using FIG. 7. The assignment system may contain a relational database, which is shown schematically in FIG. 7 as table 700. The assignment system assigns to the cop 91 an identification of a point in time of the winding of the cop 91 and an identification of the spinning position 21 on which it was produced. An identification of a point in time of unwinding the cop 91 can be, for example, a so-called doff number, i.e. a natural number which uniquely identifies a setting down (doffing) of cops 91 produced at the same time by ring spinning machine 2 and which is increased by one for each subsequent doff. The doff numbers are listed in a first column 701 of table 700. An identification of the spinning position 21, on which the cop 91 was produced, can be made by means of a spinning position number. The spinning position numbers are listed in a second column 702 of table 700. A doff number and the corresponding spinning position number together uniquely identify one line of table 700 each, so that they can be used as so-called keys in the database. This is indicated in FIG. 7 by a frame 705 around the two key columns 701, 702.

Furthermore, the assignment system assigns an identification carrier to the cop 91 and also stores identification data of the identification carrier in the relational database. For this purpose, the assignment system can comprise a cop tracking system, which is known per se and need not be discussed here in detail. As described e.g. in EP—3'305'953 A1, each cop 91 can be transported from the ring spinning machine 2 to the winding machine 3 on a bobbin plate provided with an RFID label. When leaving the ring spinning machine 2, the RFID label is written with identification data that uniquely identifies the doff number and the spinning position number. The identification data are listed in a third column 703 of table 700, e.g. as natural numbers, each of which uniquely identifies a cop 91, at least during its feeding to winding positions 31.

Finally, a fourth column 704 of table 700 lists the corresponding spinning data, e.g. the number of yarn breaks per hour.

Table 700 can therefore be read as follows: During doff 0001, there were 0.67 thread breaks per hour at spinning position 001L; the cop produced in this way is identified as "14377".

Let us revert back to FIG. 1 again. The functions of the assignment system can be performed by the spinning monitoring control unit 43, the spinning expert system 45, the central control and evaluation unit 6, the yarn expert system 55, the yarn monitoring control unit 53, the feed control unit 33 and/or by other units.

According to the invention, the feed control unit 33 is adapted to make a decision on feeding a respective cop 91 to one of the winding positions 31, taking into account the spinning data assigned to the cop 91 by the assignment system. The decision is preferably made on at least one of the following questions:

Is the cop 91 fed to one of the winding positions 31?

A cop 91, whose spinning data indicate that it was wound at a poorly functioning spinning position 21, can be sorted out as waste without ever being fed to a winding position 31. For this purpose, the ring spinning system 1 can include a separating station 35 to which the "bad" cops are fed.

The cop 91 is fed to which of the winding positions 31?

Classes of cops 91 with different spinning data are separated locally. The winding positions 31 are divided into several, e.g. two, groups. Cops 91 with "better" spinning data are fed to a first group of winding positions 31, while cops 91 with "worse" spinning data are fed to a second group of winding positions 31.

When is the cop 91 fed to one of the winding positions 31?

Classes of cops 91 with different spinning data are separated in time. Cops 91 with "better" spinning data are rewound at a different time than cops 91 with "worse" spinning data. One or more separating stations 35 can be used for intermediate storage of those classes of cops 91 which are only intended for rewinding at a later stage. The cops 91 temporarily stored in this way are fed to the winding machine 3 at the appropriate time, which is indicated by a dashed arrow 36.

These and other aspects of the invention are explained in more detail below using FIGS. 2-5.

In one embodiment, the spinning monitoring control unit 43 determines the spinning data for the individual cops 91. For each cop 91, the spinning data, the doff number and the spinning position number are stored in a relational database (see FIG. 7). The database can be located in the spinning monitoring unit 43, in the spinning expert system 45, in the evaluation unit 6, in the yarn expert system 55, in the yarn monitoring control unit 53, in the feed control unit 33, in another processing unit or distributed over several of the mentioned units. Two classes of similar spinning data are specified, namely permissible spinning data for properly functioning spinning positions 21 and impermissible spinning data for insufficiently functioning spinning positions 21. Each cop 91 is classified into one of the two classes according to the spinning data assigned to it. In the example in FIG. 7, cops 91 with two or less yarn breaks per hour can be classified as permissible, so that, for example, cops 91 with doff number 0001 from spinning position 003L is not permissible. Each cop 91 is transported from ring spinning machine 2 to winding machine 3 on a bobbin plate provided with an RFID label. When leaving the ring spinning machine 2, the RFID label is written with identification data, which can be uniquely identified by the doff number and the spinning position number. The identification data are also stored in the relational database (see FIG. 7). When the cop 91 arrives at winding machine 3, the identification data is read from the RFID label. The corresponding spinning data are read out of the database, wherein the doff number and the spinning position number are used as a key to identify the spinning data. If the respective spinning data prove to be inadmissible, the feed control unit 33 feeds the respective cops 91 classified as inadmissible to the separating station 35, otherwise to one of the winding positions 31. Thus, all cops 91 classified as permissible are rewound on the winding machine 3, while all cops 91 classified as inadmissible are sorted out in the separating station 35. This ensures a uniformly good quality of the yarn 92 rewound onto the yarn bobbins 93.

The empty bobbins are removed from the winding machine 3 and returned to the ring spinning machine 2, as indicated in FIG. 1 with dashed arrows 32.

Figure 2:
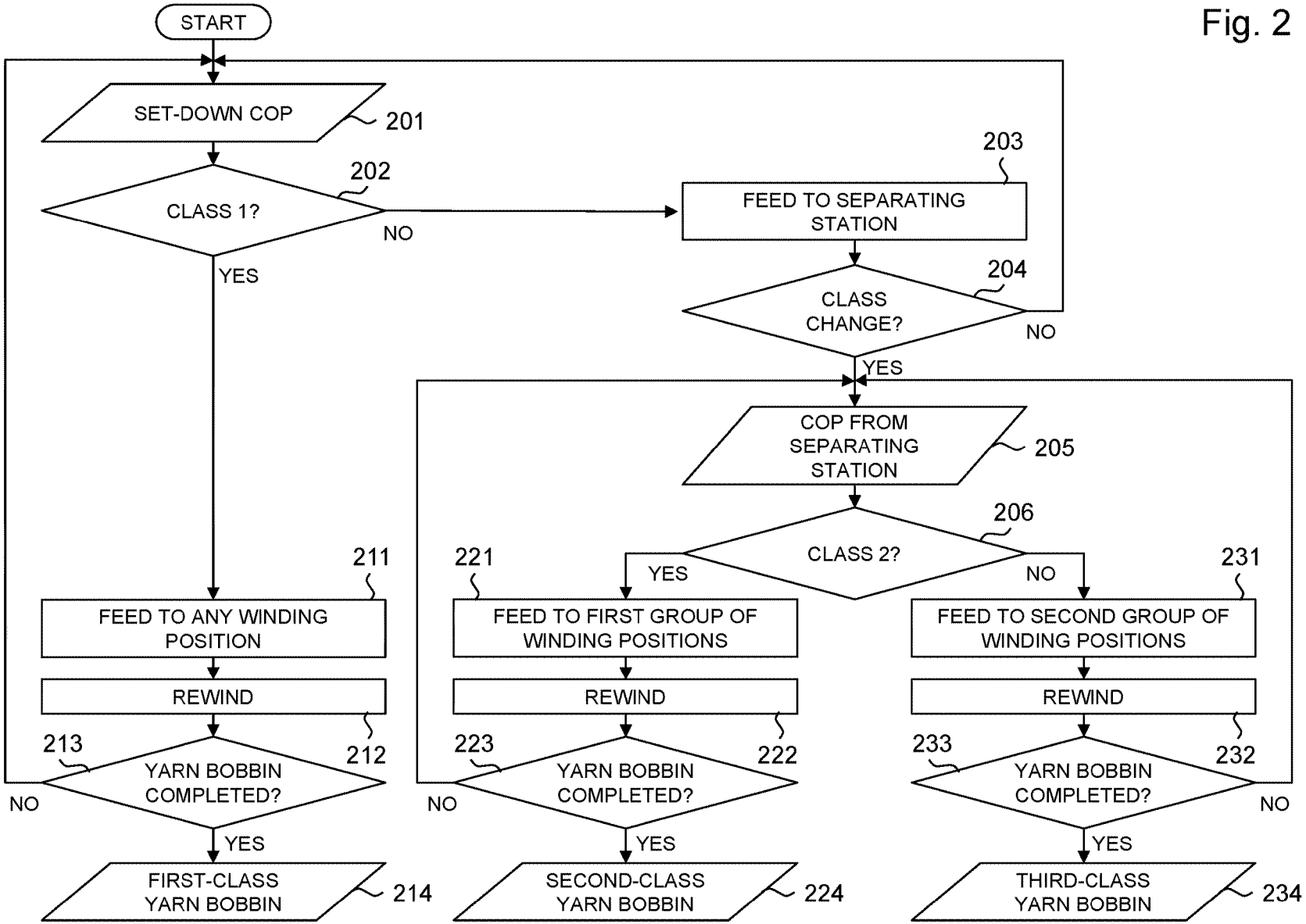
FIG. 2 illustrates a part of an embodiment of the method according to the invention by means of a flow chart.

FIG. 2 uses a flowchart to illustrate how decisions about feeding cops 91 are made in an embodiment of the method according to the invention. In this exemplary embodiment, three classes of similar spinning data are given. Cops 91 belonging to a first class are to be rewound first. Then cops 91 belonging to a second or third class are to be rewound simultaneously, but in different groups of winding positions 31.

The spinning data of a cop 91 doffed 201 by ring spinning machine 2 are first examined 202 to determine whether they belong to the first class of spinning data. If so, the cop 91 is fed 211 to any of the winding positions 31 where there is a current need for cop 91. There the cop 91 is rewound 212 onto a yarn bobbin 93. If several first-class cops 91 have been rewound onto the yarn bobbin 93 so that the yarn bobbin 93 contains the prescribed amount of yarn 92, then the yarn bobbin 93 is completed 213 and is removed 214 from the winding position 31. It contains only first-class yarn 92. If the yarn bobbin 93 is not completed 213, then another first-class cop 91 is fed 211 to the respective winding position 31.

If the spinning data of a doffed cop 91 does not belong to the first class 202, the cop 91 is first fed 203 to the separating station 35, where it is temporarily stored until all first-class cops 91 have been rewound. After all first-class cops 91 have been rewound, class change 204 takes place on the winding machine 3 and the cops 91 temporarily stored in the separating station 35 are now transported to the winding machine 3 again (arrow 36). The spinning data of a cop 91 thus transported 205 to the winding machine 3 are examined 206 to determine whether they belong to the second class of spinning data. If so, the cop 91 is fed 221 to a winding position 31, which belongs to a first group of winding positions 31. There the cop 91 is rewound 222 onto a yarn bobbin 93. If several second-class cops 91 have been rewound onto the yarn bobbin 93 so that the yarn bobbin 93 contains the prescribed amount of yarn 92, the yarn bobbin 93 is completed 223 and is removed 224 from the winding position 31. It contains second-class yarn 92. If the yarn bobbin 93 is not completed 223, another second-class cop 91 is fed 221 to the relevant winding position 31.

If the spinning data of a cop 91 transported 205 from the separating station 35 to the winding machine 3 does not belong to the second class of spinning data 206, it belongs to the third class. In this case the cop 91 is fed 231 to a winding position 31, which belongs to a second group of winding positions 31. There the cop 91 is rewound 232 onto a yarn bobbin 93, which after completion 233 contains third-class yarn 234.

Figure 5:
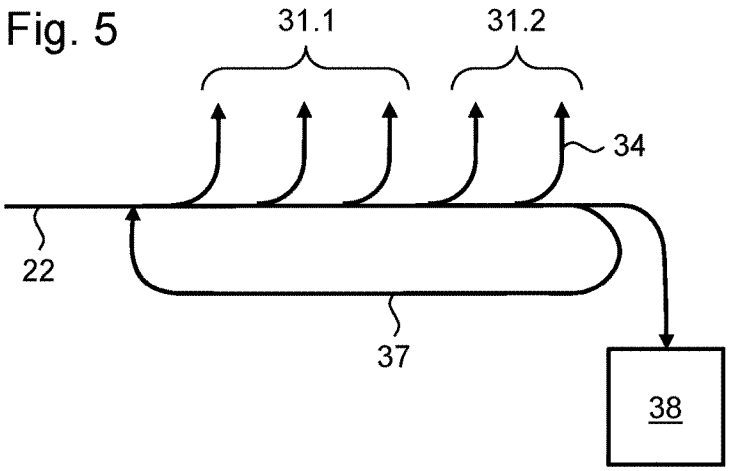
FIGS. 3-5 illustrate, by means of schematic diagrams, parts of embodiments of the method according to the invention.

Rewinding 222, 232 in the first and second group of winding positions 31 can be carried out simultaneously on the same winding machine 3 (see FIG. 5). Alternatively, depending on their respective spinning data, the cops 91 can be fed either to a first winding machine that rewinds only second-class yarn 222, or to a second winding machine that rewinds only third-class yarn 232.

Figure 3:
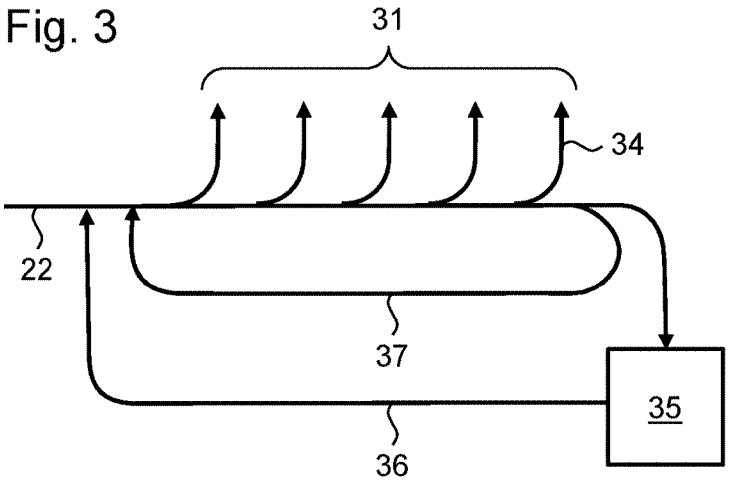
Figure 4:
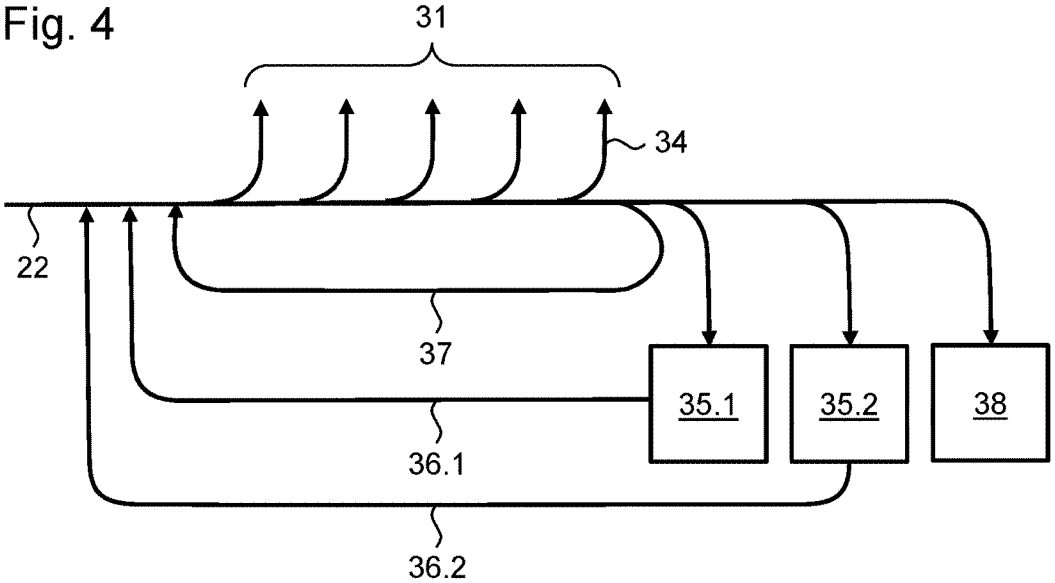

The embodiment illustrated in FIG. 2 is only an example. Two, three or more classes can be specified. All classes can be rewound simultaneously or one after the other. One of the classes can definitely be sorted out as reject without being rewound later. FIGS. 3-5 illustrate such variations. They show by means of schematic diagrams how cops 91 (not drawn in) in three different embodiments of the method according to the invention can be fed to winding positions 31. The diagrams in FIGS. 3-5 correspond to the lower right part of FIG. 1. The reference numerals 22, 34, 35 and 36 are used in FIGS. 3-5 with the same meaning as in FIG. 1; they were explained in the description of FIG. 1, so they will not be introduced again here.

The embodiment of FIG. 3 corresponds largely to that of FIGS. 1 and 2. After a cop 91 has been doffed, it is transported from the spinning position 21 to the winding machine 3, which is indicated by arrow 22. Depending on the spinning data assigned to the cop 91, it is fed either to one of the winding positions 31 or to the separating station 35. In this embodiment, only first-class cops 91 are initially fed to winding position 31 (arrows 34; FIG. 2: reference numeral 211), while all other cops 91 are temporarily stored in the separating station 35 (FIG. 2: reference numeral 203). When all first-class cops 91 have been rewound, there is a class change (FIG. 2: reference numeral 204). The cops 91 temporarily stored in the separating station 35 are transported to winding machine 3 again, as indicated by the arrow 36. Then the second-class cops 91 are fed to winding position 31, etc. (in contrast to the embodiment shown in FIG. 2, in which the second- and third-class bobbins 91 are rewound simultaneously).

It may happen in practice that even a first-class cop 91 is not fed to any of the winding positions 31, e.g. because the end of yarn 92 was not found on this cop 91. In this case, the first-class cop 91 is transported to the winding machine 3 again, which is indicated by an arrow 37; possibly the yarn end is found in a second or further attempt. The same can be carried out with the second- and higher-class cops 91 after they have been transported to the winding machine 3 again (arrow 36).

In the embodiment shown in FIG. 4, the non-first-class cops 91, which have not been fed to any of the winding positions 31, are fed either to the first separating station 35.1, a second separating station 35.2 or a reject station 38. In the first separating station 35.1, second-class cops 91 are stored, which, after the first-class cops 91 have been rewound, are transported again to winding machine 3 (arrow 36.1) and rewound there. The second, optional separating station 35.2 is used to store third-class cops 91, which after rewinding the second-class cops 91 are transported to winding machine 3 (arrow 36.2) and rewound there. Additional (optional, not drawn in) separating stations for third- and higher-class cops may be provided. In the reject station 38, cops 91 are collected whose spinning data are so bad that they are not rewound. The reject station 38 can be regarded as a special case of a separating station. In this embodiment, too, a return 37 of the unrewound first-class cops 91 can be provided.

In the embodiments of FIGS. 3 and 4, the separation of the different classes of cops 91 is done chronologically: The different classes of cops 91 are rewound on the same winding positions 31, but chronologically one after the other. FIG. 5 on the other hand shows an embodiment with a local separation: The different classes of cops 91 are rewound simultaneously, but on different groups of winding positions 31. For example, a first-class cop 91 can be fed to a winding position from a first group 31.1 of winding positions, while a second-class cop 91 is fed to a winding position from a second group 31.2 of winding positions. This corresponds to the procedure shown in the lower right part of FIG. 2, but there for second- and third-class cops 91. Cops 91 that are worse than second class are collected in the reject station 38. As in the previously described embodiments, more than two classes of similar spinning data can be formed in the embodiment of FIG. 5. The groups 31.1, 31.2 of winding positions, which rewind cops 91 of one of the classes each, can be locally connected and separated from each other on one winding machine 3, can be distributed over several winding machines 3 or can be formed virtually on one or several winding machines 3 without being locally connected in each case.

Figure 6:
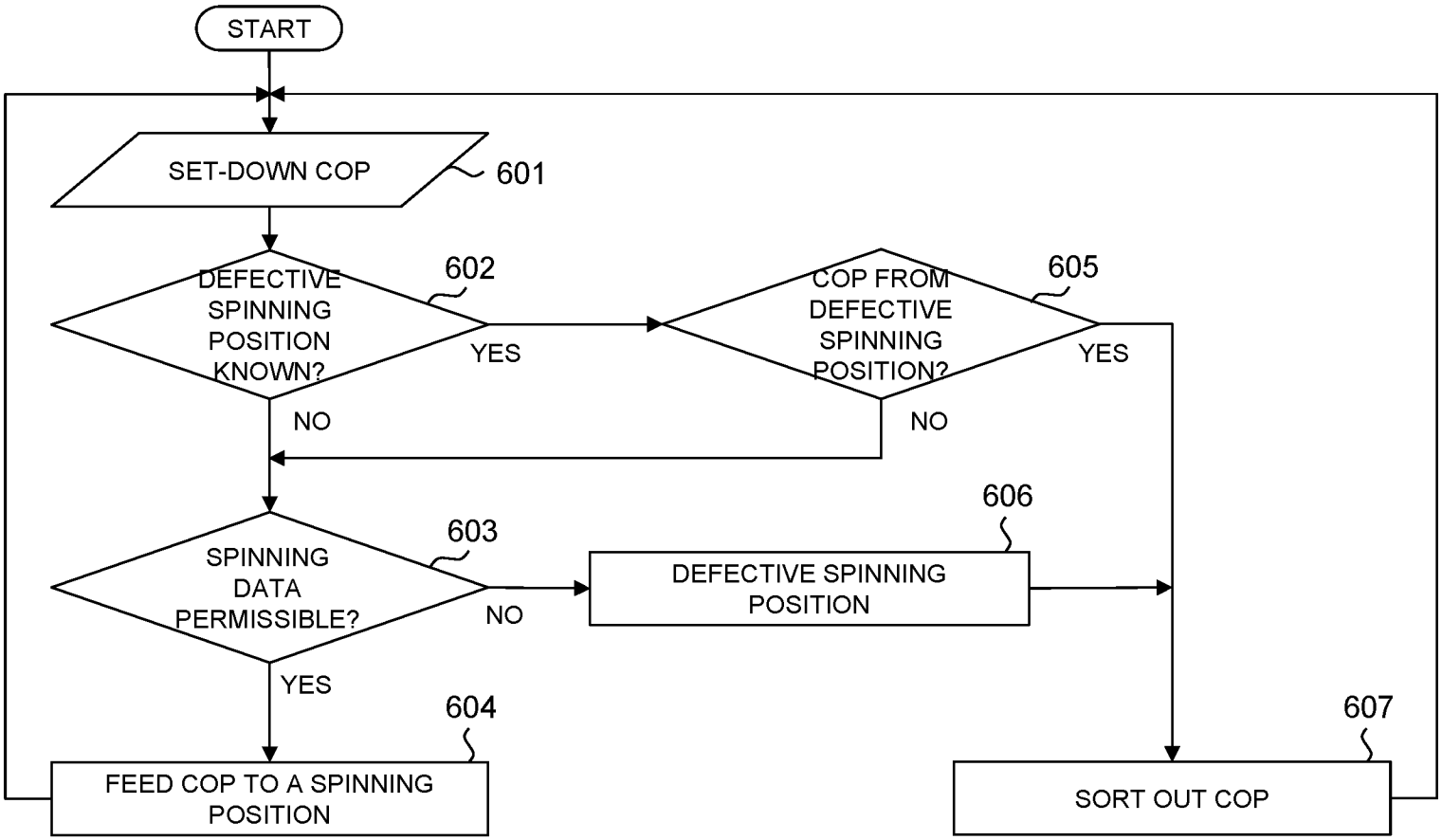
FIG. 6 illustrates a part of an embodiment of the method according to the invention by means of a flow chart.

The flow chart of FIG. 6 illustrates part of an embodiment of the method according to the invention. It is assumed here that a spinning position 21, at which a cop 91 was once wound with impermissible spinning data, is defective or faulty and will in future repeatedly produce cops 91 with impermissible spinning data. An identification of such a defective spinning position 21, e.g. its spinning position number, is stored separately.

For each cop 91 doffed 601 by ring spinning machine 2, the system first asks 602 whether at least one spinning position 21 is already known and stored as defective spinning position 21. If not, the spinning data of the cop 91 are checked for admissibility 603. If the spinning data are admissible, the cop 91 is fed 604 to one of the winding positions 31 and rewound there. Otherwise, the spinning position 21 at which the cop 91 was wound up is stored 606 as defective spinning position 21 and the cop 91 is sorted out as a reject 607.

If, on the other hand, at least one spinning position 21 is already known and stored 602 as defective spinning position 21, it is asked 605 whether the cop 91 has been wound up at one of the known defective spinning positions 21. If so, the cop 91 can be sorted out 607 as a reject without further examination of its spinning data, thus saving time and computing effort for an examination of the spinning data. Only if the cop 91 has been wound on a spinning position 21 that has worked perfectly so far, its spinning data must be examined 603 for its admissibility. If the spinning data prove to be inadmissible, the spinning position 21 in question is stored 606 as defective spinning position 21 and cop 91 is sorted out 607 as a reject.

For simplicity's sake, the exemplary embodiment in FIG. 6 shows a sorting out 307 of cop 91. In addition or as an alternative to the sorting out 307, a classification can take place as explained in the above-mentioned examples. It can be assumed that a spinning position 21, where once a cop 21 with second-class spinning data has been wound, will in future always produce cops 21 with second-class spinning data. Analogous assumptions can be made for third- and higher-class spinning data and spinning positions 21. Second- and higher-class cops 91 from such spinning positions 21 can be processed according to one of the embodiments described above . It is important to note that further analysis of the spinning data of such cops 91 is not necessary.

It is desirable to repair a defective spinning position 21 as quickly as possible in order to achieve the desired quality of the yarn produced and a high productivity of the ring spinning system 1. For this purpose, a corresponding instruction can be issued to the operator on the input and output unit 61 (see FIG. 1). Alternatively, the central control and evaluation unit can trigger an automatic repair of the defective spinning position 21.

It is understood that the present invention is not limited to the embodiments discussed above. With knowledge of the invention, the person skilled in the art will be able to derive further variants which are also part of the subject matter of the present invention.

LIST OF REFERENCE NUMERALS

1 Ring spinning system
2 Ring spinning machine
21 Spinning position
22 Transport of cops from the ring spinning machine to the winding machine
3 Winding machine
31 Winding position
31.1, 31.2 Groups of winding positions
32 Feeding-in of empty cops from the winding machine to the ring spinning machine
33 Feed control unit
34 Feeding a cop to one of the winding positions
35, 35.1, 35.2 Separating stations
36, 36.1, 36.2 Feeds of temporarily stored cops to the winding machine
37 Return of cops
38 Reject station
4 Spinning monitoring system
41 Spinning sensor
42 First data line
43 Spinning monitoring control unit
45 Spinning expert system
5 Yarn monitoring system
51 Yarn sensor
52 Second data line
53 Yarn monitoring control unit
55 Yarn expert system
6 Central control and evaluation unit
61 Mobile device
62 Third data line
91 Cop
92 Yarn
93 Yarn bobbin
700 Table representing a relational database
701 Table column with doff numbers
702 Table column with spinning position numbers
703 Table column with identification data
704 Table column with spinning data
705 Frame around key columns

The invention claimed is:

1. A method for automatically operating a ring spinning system which comprises a ring spinning machine having a plurality of spinning positions for spinning yarn and a winding machine having a plurality of winding positions for rewinding the yarn, wherein:

yarn is spun at one of the spinning positions and wound into a cop, for the spinning position, values of a parameter characteristic for the operation of the spinning position, including ring traveler speed, are determined during the winding of the cop and stored as spinning data, the spinning data are assigned to the cop, the cop is doffed from the spinning position and the spinning data assigned to the cop are taken into account in an automatic decision on feeding the cop to one of the winding positions after it has been doffed, characterized in that an identification of a point in time of the winding of the cop and an identification of the spinning position are automatically assigned to the cop, and the spinning data are automatically assigned to the cop based on the identification of the point in time of winding of the cop and the identification of the spinning position.

2. The method according to claim 1, wherein:

the spinning data, the identification of the point in time of winding of the cop and the identification of the spinning position are stored in a relational database, and the identification of the point in time of winding of the cop and the identification of the spinning position in the relational database are used as a key to identify the spinning data to be assigned to the cop.

3. The method according to claim 2, wherein:

an identification carrier is assigned to the cop, identification data of the identification carrier are stored in the relational database, and the identification of the point in time of winding of the cop and the identification of the spinning position in the relational database are used as keys for the identification of both the spinning data to be assigned to the cop and the identification data of the identification carrier.

4. The method according to claim 1, wherein the same decision as on feeding of a first cop is taken for a plurality of subsequent cops wound after the first cop at the same spinning position as the first cop without taking into account their spinning data.

5. The method according to claim 1, wherein the decision is made on at least one of the following questions:

is the cop fed to one of the winding positions, the cop is fed to which of the winding positions, and when is the cop fed to one of the winding positions.

6. The method according to claim 1, wherein the cop is sorted out after being doffed and is not fed to any of the winding positions at least during a waiting period.

7. The method according to claim 1, wherein:

at least two classes of mutually similar spinning data are formed, for each of the at least two classes the decision is made and a result of the decision is assigned to the respective class, the cop is classified into one of the at least two classes according to the stored spinning data, and the cop is processed after doffing according to the result assigned to the respective class.

8. The method according to claim 7, wherein at each of the winding positions the yarn is rewound from the cop onto a yarn bobbin and first cops classified in the same class are fed one after the other in time to one of the winding positions in such a way that the yarn wound on the first cops is rewound onto a single yarn bobbin.

9. The method according to claim 8, wherein the cops classified in the same class are temporarily stored after being set down before they are fed to the winding position.

10. The method according to claim 1, wherein the parameter characteristic of the operation of the spinning position further includes at least one of number of yarn breaks per unit of time, air temperature, and air humidity.

11. An automatic ring spinning system, comprising:

a ring spinning machine having spinning positions for spinning yarn and for winding the yarn onto cops, where one each of the spinning positions is associated with one each of the cops, a spinning monitoring system for monitoring the operation of the spinning positions, having spinning sensors, with one each of the spinning sensors associated with one each of the spinning positions for measuring spinning measured quantities, and a spinning monitoring control unit connected to the spinning sensors, adapted to receive the spinning measured quantities from the spinning sensors during the winding of the cops, to determine therefrom values of a parameter characteristic for the operation of the spinning positions, including ring traveler speed, and to store them as spinning data, a set-down device for setting down the cops from the spinning positions, a winding machine having winding positions for rewinding the yarn from the set down cops onto yarn bobbins, a feeding system controlled by a feed control unit for feeding the yarn from the set down cops to the yarn bobbins, and an assignment system for assigning the spinning data to the cops from which the spinning data was read, wherein the feed control unit is connected to the spinning monitoring control unit and is adapted to make a decision on feeding a respective one of the cops to an automatically selected one of the winding positions, taking into account the spinning data assigned to the respective one of the cops by the assignment system, characterized in that the assignment system is adapted for the purpose, of assigning to each of the cops an identification of a point in time of winding of each of the cops and an identification of the spinning position on which each of the cops was wound and of assigning the spinning data to each of the cops on the basis of the identification of the time of winding of each of the cops and the identification of the spinning position.

12. The automatic ring spinning system according to claim 11, wherein the assignment system contains a relational database which is adapted for the purpose of:

storing the spinning data, the identification of the point in time of winding of the cop and the identification of the spinning position, and using the identification of the point in time of winding of the cop and the identification of the spinning position as a key to identify the spinning data to be assigned to the cop.

13. The automatic ring spinning system according to claim 12, wherein the assignment system is adapted for the purpose of:

assigning an identification carrier to the cop, storing identification data of the identification carrier in the relational database, and using the identification of the point in time of winding of the cop and the identification of the spinning position in the relational database as a key for the identification of both the spinning data to be assigned to the cop and the identification data of the identification carrier.

14. The automatic ring spinning system according to claim 11, wherein the assignment system is adapted to apply the same decision made in regard to feeding a first of the cops to subsequent ones of the cops, which subsequent cops have been wound after the first cop and at the same spinning position as the first cop, without taking into account the spinning data associated with the subsequent cops.

15. The automatic ring spinning system according to claim 11, additionally comprising a separating station for receiving such cops which are sorted out by the feed control unit and are not fed to any of the winding positions at least during a waiting period.

16. The automatic ring spinning system according to claim 11, wherein the spinning monitoring control unit is further adapted to determine values of the parameter characteristic for the operation of the spinning position from at least one of number of yarn breaks per unit time, air temperature, and air humidity.

* * * * *